US008677976B2

(12) United States Patent
Maruyama et al.

(10) Patent No.: US 8,677,976 B2
(45) Date of Patent: Mar. 25, 2014

(54) HIGH PRESSURE FUEL PUMP

(75) Inventors: Noriyoshi Maruyama, Fujisawa (JP); Tomoyuki Koike, Zama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 363 days.

(21) Appl. No.: 13/059,358

(22) PCT Filed: Jun. 29, 2009

(86) PCT No.: PCT/JP2009/062230

§ 371 (c)(1),
(2), (4) Date: Feb. 16, 2011

(87) PCT Pub. No.: WO2010/021208

PCT Pub. Date: Feb. 25, 2010

(65) Prior Publication Data

US 2011/0146626 A1 Jun. 23, 2011

(30) Foreign Application Priority Data

Aug. 20, 2008 (JP) ..... 2008-211490

(51) Int. Cl.
*F02M 59/44* (2006.01)
*F02M 59/10* (2006.01)

(52) U.S. Cl.
USPC ..... 123/495; 123/509; 123/DIG. 5; 417/470

(58) Field of Classification Search
USPC ..... 123/495, 445, 446, 449, 450, 461, 506, 123/508, 509, 514, 1 A, 196 R, 196 V, 123/DIG. 5, 90.33; 417/470
See application file for complete search history.

(56) References Cited

U.S. PATENT DOCUMENTS

| | | | | |
|---|---|---|---|---|
| 5,567,134 | A * | 10/1996 | Inoue | 417/490 |
| 5,603,303 | A | 2/1997 | Okajima et al. | |
| 6,336,445 | B1 | 1/2002 | Yamazaki et al. | |
| 8,011,350 | B2 * | 9/2011 | Oono | 123/447 |
| 2003/0103853 | A1 * | 6/2003 | Asayama et al. | 417/470 |
| 2005/0098155 | A1 * | 5/2005 | Yamazaki et al. | 123/431 |

(Continued)

FOREIGN PATENT DOCUMENTS

| | | | |
|---|---|---|---|
| CN | 1288103 | A | 3/2001 |
| EP | 1 344 932 | B1 | 12/2005 |

(Continued)

*Primary Examiner* — John T. Kwon
*Assistant Examiner* — Johnny Hoang
(74) *Attorney, Agent, or Firm* — Foley & Lardner LLP

(57) ABSTRACT

A high pressure fuel pump (20) that pressurizes and supplies a fuel by driving a cam (21) such that a plunger (23) reciprocates, the high pressure fuel pump (20) comprises a lifter guide (25) having a guide hole (25A), a lifter (22) that is disposed between the cam (21) and the plunger (23) and is fitted into the guide hole (25A) to be free to slide so as to transmit a driving force from the cam (21) to the plunger (23), an oil collection portion (27) that is provided above the guide hole (25A) so as to surround a periphery of the lifter (22), and stores a lubricating oil for lubricating a sliding portion between the lifter (22) and the guide hole (25A), and an oil supply passage (25C) for supplying the lubricating oil to the oil collection portion (27). As a result, a reduction in a lubricating performance with regard to the lifter (22) in a position away from an opening portion of the oil supply passage (25C) is suppressed.

4 Claims, 4 Drawing Sheets

(56) References Cited

U.S. PATENT DOCUMENTS

| | | | | |
|---|---|---|---|---|
| 2006/0104843 | A1* | 5/2006 | Inoue | 417/490 |
| 2006/0207563 | A1* | 9/2006 | Kinose | 123/431 |
| 2007/0128058 | A1* | 6/2007 | Kitamura | 417/437 |
| 2008/0178845 | A1* | 7/2008 | Shimai | 123/446 |
| 2008/0216797 | A1* | 9/2008 | Oono | 123/447 |
| 2010/0147267 | A1* | 6/2010 | Kato et al. | 123/456 |

FOREIGN PATENT DOCUMENTS

| | | | |
|---|---|---|---|
| JP | 8-14140 | A | 1/1996 |
| JP | 10-30526 | A | 2/1998 |
| JP | 2001-3835 | A | 1/2001 |
| JP | 2003-269296 | A | 12/2005 |
| JP | 2007-177704 | A | 7/2007 |

* cited by examiner

HIGH PRESSURE FUEL PUMP

TECHNICAL FIELD

This invention relates to a plunger type high pressure fuel pump for supplying a fuel to an internal combustion engine.

BACKGROUND ART

JP2003-269296A, published by the Japan Patent Office in 2003, discloses a high pressure fuel pump with which a lifter lubricating performance can be secured in a position where a contact pressure increases by forming an oil supply passage for supplying a lubricating oil in a lifter guide and providing a lifter side opening portion of the oil supply passage in the vicinity of the position where the contact pressure increases.

DISCLOSURE OF THE INVENTION

In the high pressure fuel pump according to the prior art, an amount of the lubricating oil between the lifter and the lifter guide decreases steadily from the lifter side opening portion of the oil supply passage, leading to a reduction in the lifter lubricating performance.

It is therefore an object of this invention to provide a high pressure fuel pump with which a lifter lubricating performance can be improved.

To achieve this object, this invention provides a high pressure fuel pump that pressurizes and supplies a fuel by driving a cam such that a plunger reciprocates, the high pressure fuel pump comprising a lifter guide having a guide hole, a lifter that is disposed between the cam and the plunger and is fitted into the guide hole to be free to slide so as to transmit a driving force from the cam to the plunger, an oil collection portion that is provided above the guide hole so as to surround a periphery of the lifter, and stores a lubricating oil for lubricating a sliding portion between the lifter and the guide hole, and an oil supply passage for supplying the lubricating oil to the oil collection portion.

The details as well as other features and advantages of this invention are set forth in the remainder of the specification and are shown in the accompanying drawings.

BEST MODES FOR CARRYING OUT THE INVENTION

Figure 1:
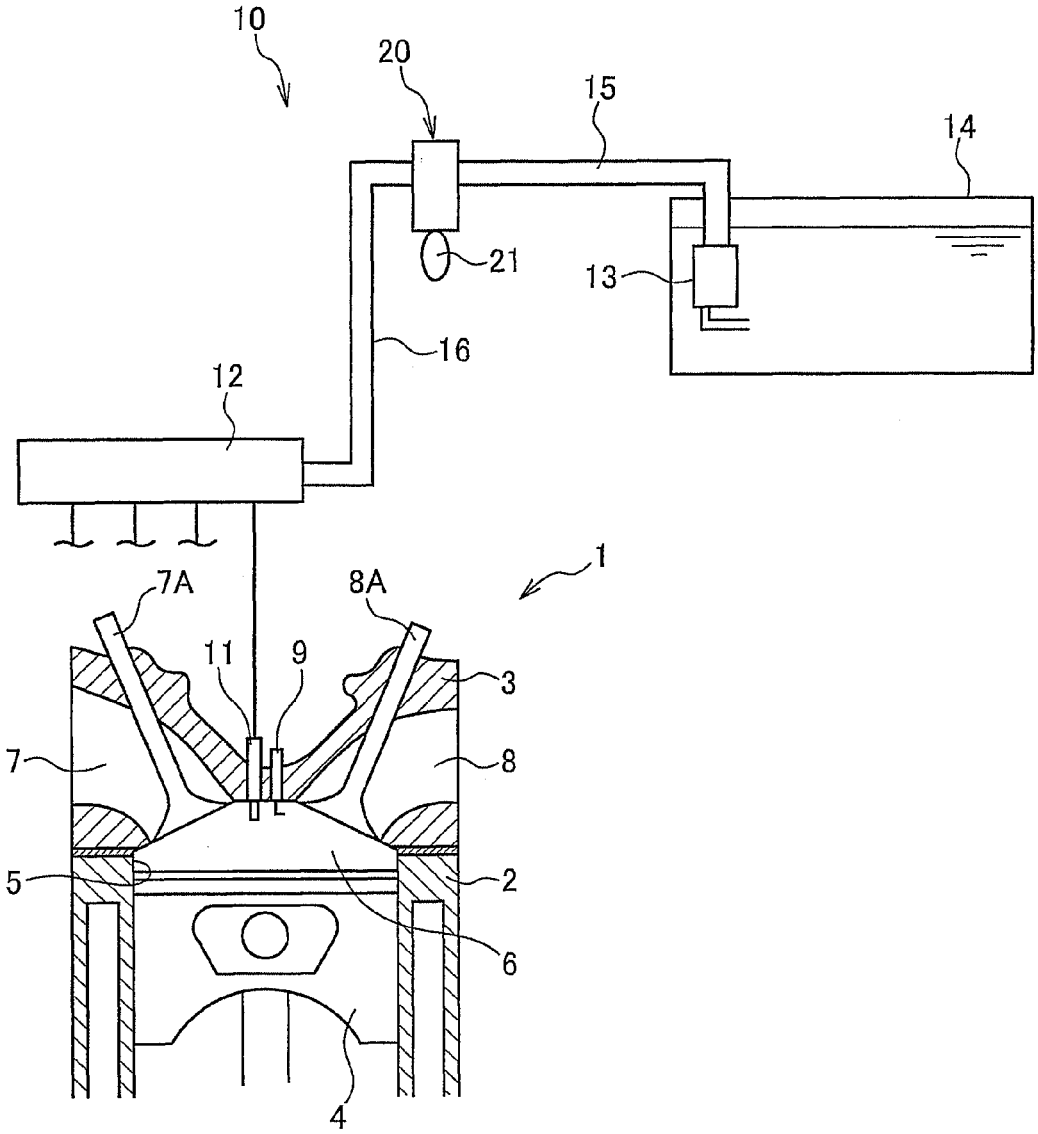
FIG. 1 is a schematic diagram showing a vehicle internal combustion engine including a high pressure fuel pump according to a first embodiment of this invention.
Figure 2:
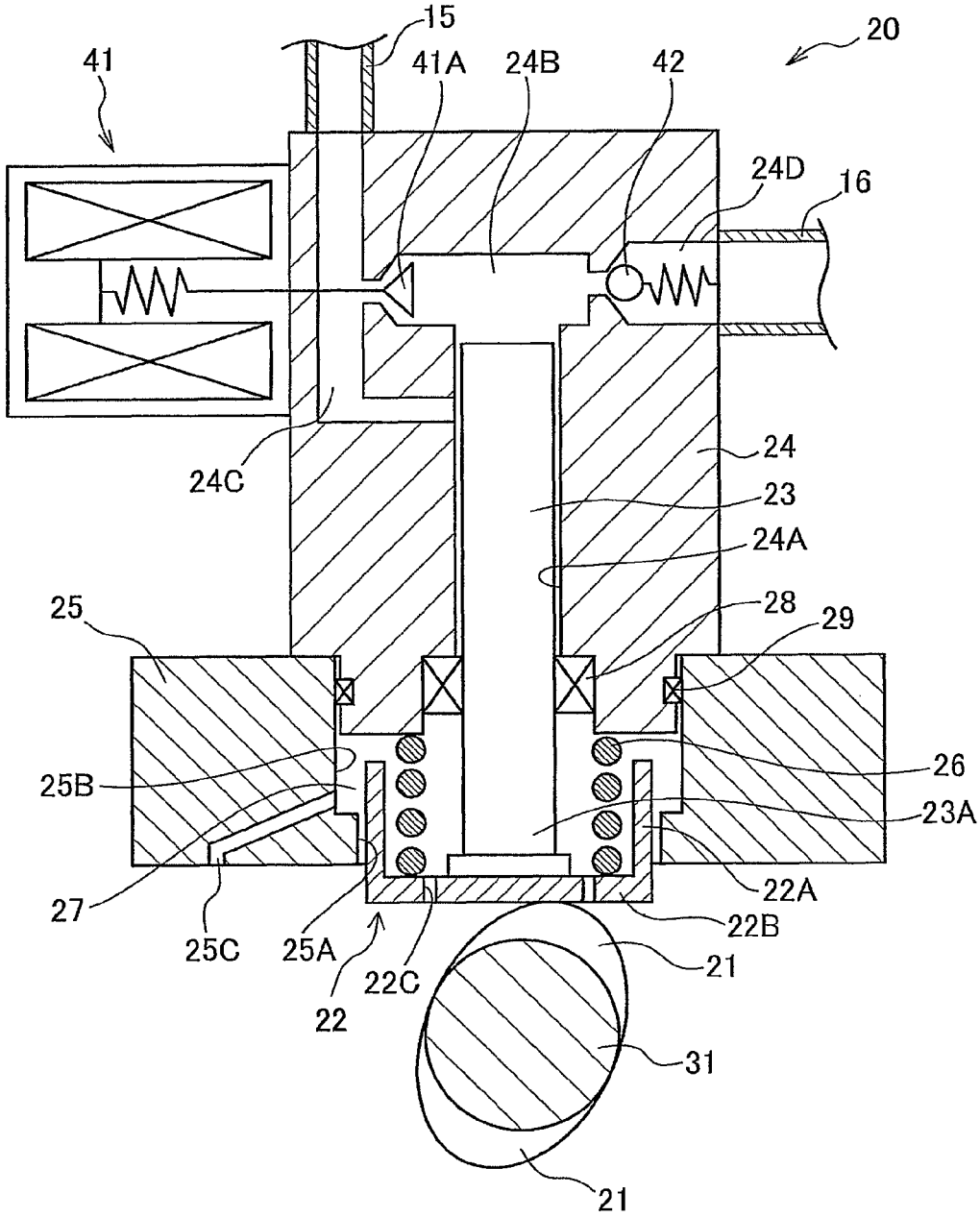
FIG. 2 is a schematic longitudinal sectional view of the high pressure fuel pump.
Figure 3:
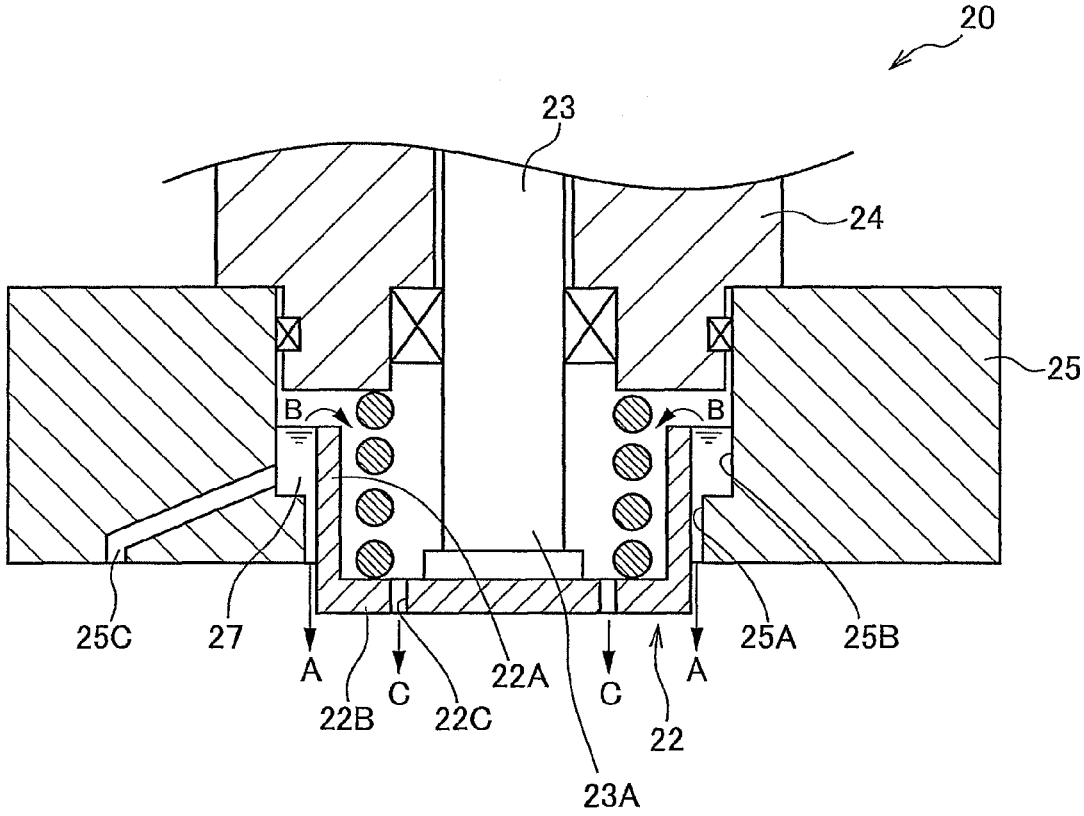
FIG. 3 is an enlarged schematic longitudinal sectional view showing the vicinity of a lifter of the high pressure fuel pump.

Referring to FIGS. 1 to 3, a first embodiment of this invention will be described.

Referring to FIG. 1, a vehicle internal combustion engine 1 is an inline four cylinder engine comprising a cylinder block 2 and a cylinder head 3 disposed on an upper side of the cylinder block 2.

The cylinder block 2 is formed with a cylinder 5 in which a piston 4 is accommodated to be free to slide. A combustion chamber 6 is formed from a crown surface of the piston 4, a wall surface of the cylinder 5, and a lower surface of the cylinder head 3. When an air fuel mixture is burned in the combustion chamber 6, the piston 4 receives combustion pressure generated through combustion of the air fuel mixture and reciprocates through the cylinder 5.

An intake port 7 for supplying fresh air to the combustion chamber 6 and an exhaust port 8 for discharging exhaust gas from the combustion chamber 6 are formed in the cylinder head 3.

An intake valve 7A is provided in the intake port 7. The intake valve 7A is driven by an intake cam to open and close the intake port 7 in accordance with a vertical motion of the piston 4.

An exhaust valve 8A is provided in the exhaust port 8. The exhaust valve 8A is driven by an exhaust cam to open and close the exhaust port 8 in accordance with the vertical motion of the piston 4.

A spark plug 9 is disposed between the intake port 7 and the exhaust port 8 near the center of the cylinder head 3. The spark plug 9 ignites the air fuel mixture formed in the combustion chamber 6.

A fuel is supplied to the internal combustion engine 1 by a fuel supply device 10. The fuel supply device 10 comprises a fuel injection valve 11, a delivery pipe 12, a high pressure fuel pump 20, a low pressure fuel pump 13, and a fuel tank 14.

The fuel injection valve 11 is provided in the cylinder head 3 for each cylinder of the internal combustion engine 1. The fuel injection valve 11 injects an amount of fuel corresponding to engine operating conditions directly into the combustion chamber 6 at a predetermined timing. The fuel supplied to the fuel injection valves 11 is stored in the fuel tank 14.

The fuel stored in the fuel tank 14 is discharged from the low pressure fuel pump 13 which is provided in the fuel tank 14. The discharged low pressure fuel is supplied to the high pressure fuel pump 20 through a low pressure fuel passage 15.

The high pressure fuel pump 20 is a plunger type pump. The high pressure fuel pump 20 pressurizes the fuel by driving a pump cam 21 such that a plunger reciprocates. The high pressure fuel discharged from the high pressure fuel pump 20 flows into the delivery pipe 12 through a high pressure fuel passage 16 and is supplied to the respective fuel injection valves 11 via the delivery pipe 12.

Referring to FIG. 2, the high pressure fuel pump 20 of the fuel supply device 10 will be described.

The high pressure fuel pump 20 is constructed such that the pump cam 21 drives a plunger 23 via a lifter 22.

The pump cam 21 is formed integrally with a cam shaft 31 of the internal combustion engine 1, and contacts the lifter 22. The pump cam 21 rotates in accordance with a rotation of the cam shaft 31.

The lifter 22 takes a cylindrical shape that is closed on a lower end side. The lifter 22 is accommodated in a lifter guide 25, which is fixed to a lower end of a housing 24, to be capable of sliding. The lifter 22 includes a side wall portion 22A and a bottom wall portion 22B. The pump cam 21 contacts the bottom wall portion 22B of the lifter 22 from below, and a lower end 23A of the plunger 23 contacts the bottom wall portion 22B of the lifter 22 from above. A plurality of through holes 22C penetrating in an axial direction are formed in the bottom wall portion 22B to connect an inner side and an outer side of the lifter 22. A spring 26 that biases the lifter 22 to a lower side in the figure is provided between the lifter 22 and the housing 24.

The lifter guide 25 for guiding the lifter 22 is formed with a guide hole 25A that slides along the side wall portion 22A of the lifter 22, a large diameter portion 25B having a larger inner diameter than the guide hole 25A, and an oil supply passage 25C through which a lubricating oil flows.

The large diameter portion 25B is provided above the guide hole 25A. An oil collection portion 27 is formed around an outer periphery of the lifter 22 by the large diameter portion 25B and the side wall portion 22A of the lifter 22. The oil supply passage 25C opens onto the large diameter portion 25B so as to communicate with the oil collection portion 27. The lubricating oil is pumped by an oil pump, not shown in the figures, and supplied to the oil collection portion 27 through the oil supply passage 25C. It should be noted that in this embodiment, the oil collection portion 27 is invariably formed irrespective of the position of the lifter 22, but an upper end portion of the lifter 22 may slide along the guide hole 25A such that the oil collection portion 27 is eliminated when the lifter 22 descends.

The plunger 23 takes a columnar shape and is housed in the housing 24 to be capable of reciprocating. The lower end 23A of the plunger 23 projects from the housing 24 to the inside of the lifter guide 25 therebelow. The plunger 23 is sealed from the housing 24 by a seal member 28.

The housing 24 is fixed to the lifter guide 25 via an oil seal 29. The housing 24 is formed with a plunger cylinder 24A along which the plunger 23 slides, a fuel chamber 24B disposed above the plunger cylinder 24A, an inlet side passage 24C connected to the low pressure fuel passage 15, and an outlet side passage 24D connected to the high pressure fuel passage 16.

The plunger cylinder 24A is formed in a vertical axis direction of the figure so as to communicate with the fuel chamber 24B.

The fuel chamber 24B is enlarged and reduced in accordance with a position of the plunger 23 reciprocating through the plunger cylinder 24A.

The inlet side passage 24C opens onto a midway point of the plunger cylinder 24A so as to communicate with the fuel chamber 24B only when the fuel chamber 24B is enlarged.

The inlet side passage 24C also opens onto a position that communicates directly with the fuel chamber 24B. This opening portion communicates with the fuel chamber 24B via a valve body 41A of a solenoid control valve 41. The solenoid control valve 41 regulates an amount of fuel discharged from the fuel chamber 24B into the outlet side passage 24D by controlling an opening/closing timing of the valve body 41A.

The outlet side passage 24D opens onto a position that communicates directly with the fuel chamber 24B. The outlet side passage 24D communicates with the fuel chamber 24B via a check valve 42. The check valve 42 allows the fuel to be discharged from the fuel chamber 24B but prevents the fuel from flowing back.

In FIG. 2, when the plunger 23 descends such that the fuel chamber 24B is enlarged, the valve body 41A blocks communication between the inlet side passage 24C and the fuel chamber 24B and the check valve 42 prevents a backflow of the fuel from the outlet side passage 24D, and therefore a pressure in the fuel chamber 24B turns negative. At a point where the plunger 23 descending through the plunger cylinder 24A passes the plunger cylinder side opening portion of the inlet side passage 24C, the fuel flows into the plunger cylinder 24A from the inlet side passage 24C and is suctioned into the fuel chamber 24B.

When the plunger 23 starts to ascend after descending, the plunger cylinder side opening portion of the inlet side passage 24C is blocked, whereupon the fuel pressure in the fuel chamber 24B rises in accordance with a volume reduction in the plunger cylinder 24A and the fuel chamber 24B. The pressurized fuel in the fuel chamber 24B pushes open the check valve 42 and flows out into the outlet side passage 24D. By controlling the opening of the valve body 41A of the solenoid control valve 41 at this time, the amount of fuel discharged into the outlet side passage 24D from the fuel chamber 24B is regulated.

In the high pressure fuel pump 20 described above, Lubrication between the lifter 22 and the lifter guide 25 is achieved by the lubricating oil supplied from the oil supply passage 25C.

Referring to FIG. 3, lubrication of the lifter 22 and the lifter guide 25 will be described. FIG. 3 is a diagram showing an enlargement of the vicinity of the lifter 22 provided in the high pressure fuel pump 20.

The high pressure fuel pump 20 stores the lubricating oil supplied from the oil supply passage 25C in the oil collection portion 27.

When the lifter 22 slides through the guide hole 25A in a vertical direction, the lubricating oil in the oil collection portion 27 flows into a narrow gap between the side wall portion 22A of the lifter 22 and the guide hole 25A, as shown by an arrow A. The oil collection portion 27 is formed so as to surround the side wall portion 22A of the lifter 22, and therefore the lubricating oil is supplied sufficiently around the entire periphery of the lifter 22.

When the lifter 22 descends, a part of the lubricating oil in the oil collection portion 27 flows over an upper end of the side wall portion 22A to the inside of the lifter 22, as shown by an arrow B. The lubricating oil that flows to the inside of the lifter 22 lubricates a contact part between the lower end 23A of the plunger 23 and an upper surface of the bottom wall portion 22B of the lifter 22.

The lubricating oil that lubricates the contact part between the lower end 23A of the plunger 23 and the upper surface of the bottom wall portion 22B of the lifter 22 drips down to the pump cam 21 side through the through holes 22C in the lifter 22, as shown by an arrow C. The lubricating oil passing through the through holes 22C lubricates a contact part between the pump cam 21 and a lower surface of the bottom wall portion 22B of the lifter 22.

With the high pressure fuel pump 20 according to the first embodiment of this invention, the following effects can be obtained.

In the high pressure fuel pump 20, the large diameter portion 25B is provided above the guide hole 25A in the lifter guide 25, and the oil collection portion 27 is formed by the large diameter portion 25B and the side wall portion 22A of the lifter 22. The lubricating oil can therefore be supplied sufficiently around the entire periphery of the lifter 22 between the side wall portion 22A of the lifter 22 and the guide hole 25A. As a result, a reduction in a lubricating performance with regard to the lifter 22 in a position away from the opening portion of the oil supply passage 25C can be suppressed.

The lubricating oil is highly viscous, and therefore, when an engine is stopped, the lubricating oil does not flow easily into the narrow gap between the side wall portion 22A of the lifter 22 and the guide hole 25A. Hence, the lubricating oil is stored in the oil collection portion 27 after the engine is stopped so that when the engine is restarted, the lubricating oil can be supplied between the side wall portion 22A of the lifter 22 and the guide hole 25A quickly.

Figure 4:
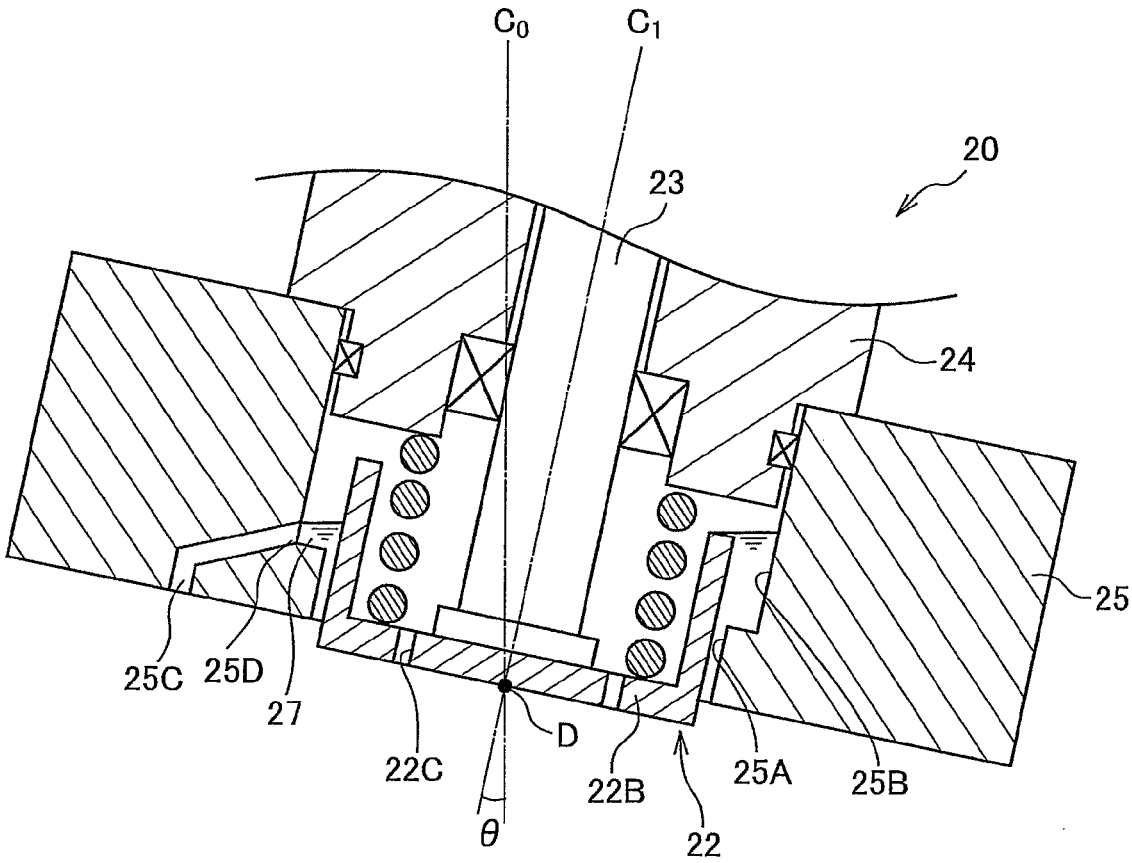
FIG. 4 is a schematic longitudinal sectional view showing a high pressure fuel pump according to a second embodiment of this invention.

Referring to FIG. 4, a second embodiment of this invention will be described.

A basic constitution of the high pressure fuel pump 20 according to the second embodiment of this invention is substantially identical to that of the first embodiment, but differs in an arrangement of the high pressure fuel pump 20 and a formation position of the oil supply passage 25C. The following description focuses on these differences.

As shown in FIG. 4, depending on the layout of the internal combustion engine 1 and accessories in an engine room of the vehicle, the high pressure fuel pump 20 may be disposed such that an axial center line $C_1$ of the lifter 22 is inclined in a clockwise direction relative to a vertical line $C_0$ passing vertically through a center D of the bottom wall portion 22B of the lifter 22, whereby an angle formed by the axial center line $C_1$ and the vertical line $C_0$ is θ.

When the high pressure fuel pump 20 is disposed at an incline in this manner, the lifter guide 25 inclines in accordance with the incline of the lifter 22. When the lifter guide 25 is inclined, a circumferential direction position of the lifter guide 25 relative to the lifter 22 is set such that an opening portion 25D of the oil supply passage 25C that opens onto the large diameter portion 25B is provided in a highest position.

By disposing the opening portion 25D of the oil supply passage 25C in this manner, the lubricating oil supplied to the oil collection portion 27 flows around the outer periphery of the side wall portion 22A of the lifter 22 from an upstream side on the left side of the figure to a downstream side on the right side of the figure even when the amount of oil supplied from the oil supply passage 25C is small, and therefore the lubricating oil can be supplied sufficiently around the entire periphery of the lifter 22 between the side wall portion 22A of the lifter 22 and the guide hole 25A. Hence, even when the high pressure fuel pump 20 is provided at an incline, a reduction in the lubricating performance with regard to the lifter 22 can be suppressed.

Although the invention has been described above with reference to certain embodiments, the invention is not limited to the embodiments described above. Modifications and variations of the embodiments described above will occur to those skilled in the art, within the scope of the claims.

The contents of JP2008-211490, with a filing date of Aug. 20, 2008 in Japan, are hereby incorporated by reference.

INDUSTRIAL APPLICABILITY

As described above, this invention achieves especially desirable effect in application to a plunger type high pressure fuel pump which supplies a fuel to an internal combustion engine.

The embodiments of this invention in which an exclusive property or privilege are claimed are defined as follows:

1. A high pressure fuel pump configured to pressurize and supply a fuel by driving a cam such that a plunger reciprocates, comprising:

a lifter guide having a guide hole;

a litter that is fitted into the guide hole to be free to slide so as to transmit a driving force from the cam to the plunger, the lifter including a cylindrical side wall portion configured to slide within the guide hole, and a bottom wall portion that closes a lower end of the side wall portion, an upper surface of the bottom wall portion being in contact with the plunger, and a lower surface of the bottom wall portion being in contact with the cam;

an oil collection portion that is located above the guide hole so as to surround a periphery of the lifter, the oil collection portion being configured to store a lubricating oil for lubricating a sliding portion between the lifter and the guide hole; and an oil supply passage configured to allow the lubricating oil to be supplied to the oil collection portion, wherein the oil supply passage is formed in the lifter guide so as to open into the oil collection portion at an opening portion, wherein the lifter and the lifter guide are disposed at an incline relative to a vertical line, and wherein the opening portion is located at a highest vertical position of a circle that (i) has an axis that is coaxial with a longitudinal axis of the lifter and (ii) passes through the opening portion.

2. The high pressure fuel pump as defined in claim 1, wherein the oil collection portion is formed by the side wall portion of the lifter and a large diameter portion which is formed above the guide hole in the lifter guide and has a larger diameter than a diameter of the guide hole.

3. The high pressure fuel pump as defined in claim 1, wherein the lifter has a through hole in the bottom wall portion.

4. The high pressure fuel pump as defined in claim 1, wherein a portion of the circle is located below the highest vertical position.

* * * * *